United States Patent [19]

Seragnoli

[11] 4,167,994

[45] Sep. 18, 1979

[54] CONVEYOR FOR FEEDING PRESHAPED CARDBOARD PIECES

[75] Inventor: Enzo Seragnoli, Bologna, Italy

[73] Assignee: G. D. Societá per Azioni, Bologna, Italy

[21] Appl. No.: 791,282

[22] Filed: Apr. 27, 1977

[30] Foreign Application Priority Data

May 6, 1976 [IT] Italy ..... 3424 A/76

[51] Int. Cl.[2] ..... B65G 47/26

[52] U.S. Cl. ..... 198/457; 198/485; 271/184

[58] Field of Search ..... 198/457, 484, 485, 489; 271/184, 225

[56] References Cited

U.S. PATENT DOCUMENTS

| | | | |
|---|---|---|---|
| 2,956,664 | 10/1960 | Brown et al. | 198/484 |
| 2,960,206 | 11/1960 | Dougherty | 198/485 |
| 3,045,819 | 7/1962 | Heidergott | 198/484 |
| 3,327,453 | 6/1967 | Willbrandt et al. | 198/485 |
| 3,360,100 | 12/1967 | Seragnoli | 198/347 |
| 3,454,149 | 7/1969 | Nigrelli et al. | 198/457 |
| 3,642,115 | 2/1972 | Prigent | 198/457 |
| 3,726,168 | 4/1973 | Glanz et al. | 198/457 |
| 3,881,721 | 5/1975 | Hitch | 198/457 |
| 4,020,942 | 5/1977 | Buchheit | 198/600 |

FOREIGN PATENT DOCUMENTS

| | | | |
|---|---|---|---|
| 652605 | 11/1962 | Canada | 198/457 |

*Primary Examiner*—Robert B. Reeves
*Assistant Examiner*—James L. Rowland
*Attorney, Agent, or Firm*—H. Dale Palmatier

[57] ABSTRACT

A conveying unit for feeding preshaped pieces of cardboard to a machine for packaging cigarettes into hinged lid packets, the unit including a first and a second conveyor arranged substantially at right angles to one another and along each of which said pieces are advanced in contact with a support surface, the second of said support surfaces being arranged at a higher level than the first, and a transfer mechanism being provided to raise said pieces one by one from said first surface, support each raised piece in said raised position, and then push the same on to said second surface.

5 Claims, 3 Drawing Figures

CONVEYOR FOR FEEDING PRESHAPED CARDBOARD PIECES

BACKGROUND OF THE INVENTION

This invention relates to a conveying unit for feeding portions of sheet material to a user machine.

More particularly, the present invention relates to a continuous belt conveying unit for feeding preshaped or punched pieces of cardboard or the like to an intermittent machine for packaging cigarettes into hinged lid packets.

As described in Italian patent No. 992.092 of the same applicant, a packaging machine of the aforesaid type may be associated with a feed and accumulation apparatus in which preshaped pieces are continuously fed into a column vessel, the lower end of which is disposed above an inlet station of a first conveyor, an outlet station of which is connected to an inlet station of a second conveyor constituting the inlet element for said packaging machine and forming an angle of 90° to said first conveyor.

In a conveying unit for feeding an intermittent packaging machine and comprising the two said conveyors forming a contained angle of 90°, transfer of the preshaped pieces from the first to the second conveyor present numerous technical problems. In this respect, the transfer of the preshaped pieces from one conveyor to the other must take place at an extremely precise rate and with extremely narrow position tolerances. To satisfy these conditions, the engagement between the preshaped pieces and transfer members arranged to transfer them from the first to the second conveyor must be always perfect, and the position assumed by the preshaped pieces on entering the second conveyor must also be perfect.

The construction of a conveying unit able to satisfy these conditions for relatively low working frequencies is generally no problem. The situation changes radically however when the working frequency exceeds a determined value, and becomes in fact prohibitive when the required working frequency is very high, as when feeding an intermittent packaging machine capable of a working frequency of the order of seven or more steps per second.

The inertia forces acting on the preshaped pieces at such speeds are such that not only must the preshaped pieces be constantly supported and guided during transfer from one conveyor to the other, but the mobile members concerned with this transfer must be of a very small number and simple structure both in order to allow them to be easily driven synchronously and so as not to require very complicated control equipment, which would considerably reduce the reliability of the conveying unit.

SUMMARY OF THE INVENTION

The present invention solves the aforesaid technical problem by providing a conveying unit of the type comprising two conveyors forming a contained angle substantially of 90° for disposing between said machine and an accumulation store for said preshaped pieces, and each comprising a support and slide surface for said preshaped pieces and means for feeding these latter stepwise along said surface, and in which an outlet station of a first of said conveyors is connected to an inlet station of the second conveyor by way of transfer means arranged to transfer the preshaped pieces from said first to said second conveyor, wherein the support and slide surface of said second conveyor is disposed at a higher level than that of the first, and said transfer means comprise lifting means which move with reciprocating motion through the support and slide surface of said first conveyor at said outlet station to raise the preshaped pieces one by one to the level of the support and slide surface of said second conveyor, mobile support means disposed above said outlet station to support each preshaped piece in said raised position, and pusher means mobile with reciprocating motion above said outlet station to and from said inlet station to laterally engage with each of said preshaped pieces in said raised position and thrust it on to said inlet station.

BRIEF DESCRIPTION OF THE DRAWINGS

Further characteristics and advantages of the present invention will be evident from the description given hereinafter with reference to the accompanying drawings which illustrate one non-limiting embodiment thereof, and in which.

DETAILED DESCRIPTION OF THE INVENTION

Figure 1:
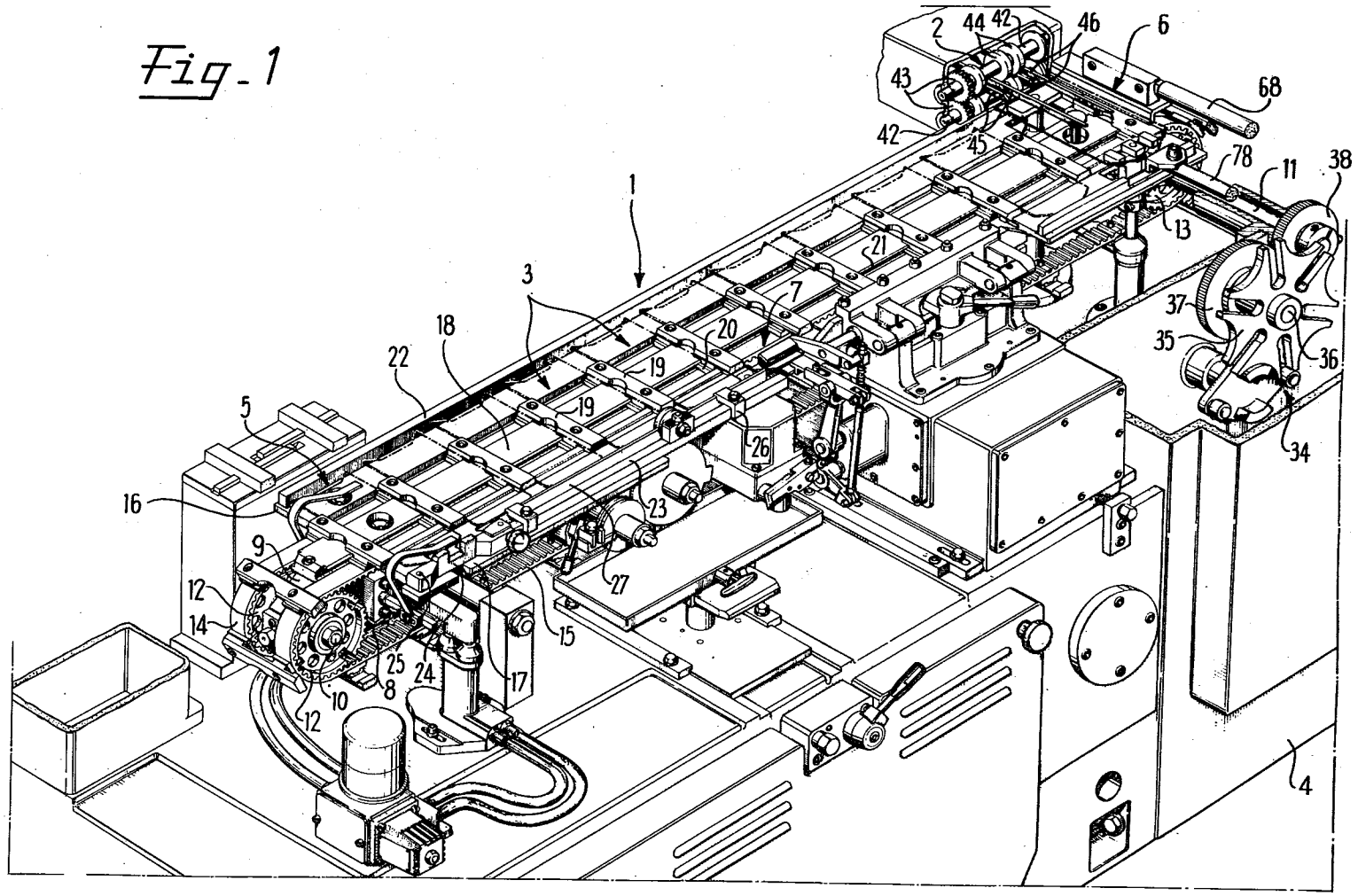
FIG. 1 is a three-quarter partial perspective view from above, with parts sectioned and parts removed for clarity, of a conveying unit constructed in accordance with the present invention.

FIG. 1 shows a conveying unit comprising two conveyors 1 and 2 forming a contained angle of 90°, and arranged to feed preshaped pieces 3 to an intermittent machine (not shown) for packaging cigarettes into hinged lid packets.

The conveyor 1 is supported in a substantially horizontal position by a base 4 and extends between an inlet station 5, and an outlet station 6 at which the preshaped pieces 3 are transferred to a second conveyor 2. At a point along the conveyor 1 there is disposed a folding station 7, arranged to fold a flap constituting one of the ends of the preshaped pieces 3.

The conveyor 1 comprises a longitudinal support and guide member 8 disposed in a substantially horizontal position above the base 4 and with two blocks 9 (only one of which is shown in FIG. 1) connected to its two ends to support two shafts 10 and 11 disposed horizontally transverse to the axis of the longitudinal member 8. On the two ends of the shaft 10 there are rotatably mounted to gear wheels 12 each of which supports and engages, together with a corresponding gear wheel 13 keyed on to the shaft 11, with two endless belts 14 and 15 respectively, extending parallel to the axis of the longitudinal member 8.

Two flat lateral plates 16 and 17 extending along the longitudinal member 8 are connected thereto and project laterally therefrom in opposing transverse directions, and a longitudinal central beam 18 is connected to the member 8 and comprises an upper surface coplanar with the upper flat surfaces of the plates 16 and 17 to constitute, with these two latter surfaces, a support and slide surface for the preshaped pieces 3. Each of these latter is fed and conveyed into a respective conveying compartment defined by two tie bars 19 extending transversely above the beam 18 and connected by its ends to the belts 14 and 15 via guide shoes 20. Each shoe 20 comprises laterally a flat surface disposed in contact with a lateral flat surface of the beam 18 and a substantially rectangular lateral appendix engaged slidably in a respective lateral longitudinal groove 21 in the beam 18.

The transverse position of the preshaped pieces 3 in the relative conveying compartments is controlled on one side by a guide rib or shoulder 22 connected to the upper surface of the plate 16, and on the other by a guide rib or shoulder 23 connected to the upper surface of the plate 17. The guide shoulder 22 extends longitudinally over the entire plate 16, while the guide shoulder 23 is interrupted, at least partly, at the stations 5, 6 and 7. In particular, at the station 5, the shoulder 23 is replaced by a control gate 24 rotatably mounted on a pin 25 carried by the plate 17.

Figure 2:
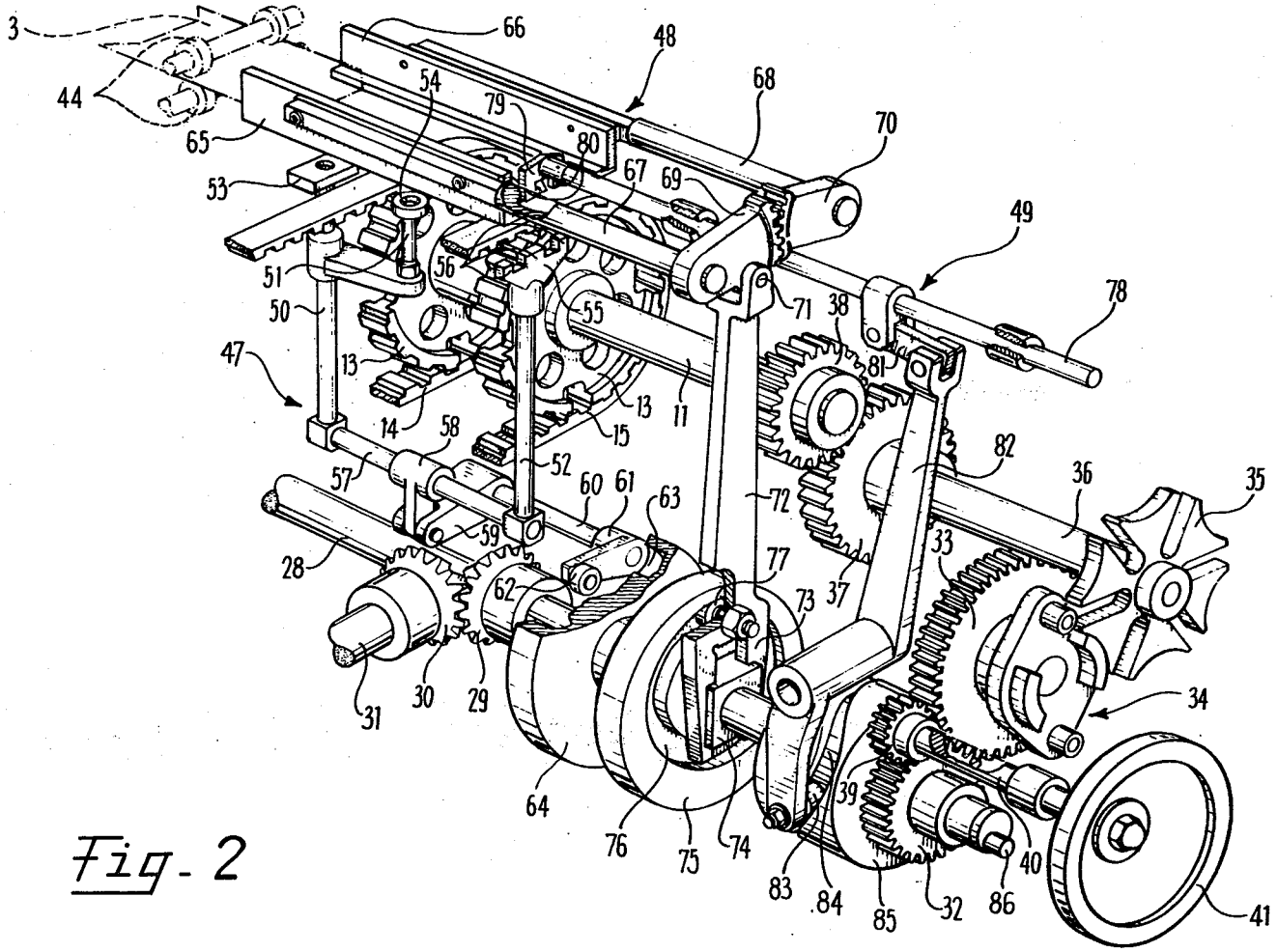
FIG. 2 is a diagrammatic perspective view, with parts sectioned and parts removed for clarity, of an operating and control unit for some mobile elements of the conveying unit shown in FIG. 1.

In order to prevent the preshaped pieces 3 from becoming detached vertically from the plates 16 and 17 and beam 18, brackets 26 are connected to the shoulder 23 to project above the plate 17, and support a vertical guide knife 27 extending over that portion of the conveyor 1 lying between the stations 5 and 7. As shown in FIG. 2, in the base 4 there is transversely mounted a drive shaft 28 deriving its motion from a drive unit (not shown) and comprising keyed thereon a bevel pinion 29 engaging with a bevel pinion 30 keyed on to the end of a shaft 31. This latter extends longitudinally along the base 4 and acts as a power take-off for an operating and control unit (not shown) disposed at the inlet station 5.

The shaft 28 comprises keyed thereon a cylindrical gear wheel 32 arranged to transmit motion in the manner described hereinafter to a stepwise drive unit for the belts 14 and 15.

The gear wheel 32 rotates, via the gear wheel 33 of axis parallel to the shafts 28, a device of known type 34 provided with idle rollers and arched sectors for driving intermittently or stepwise the Maltese cross 35 mounted at one end of the shaft 36 parallel to the shaft 28. On the second end of the shaft 36 there is keyed the gear wheel 37, which transmits its intermittent rotation via the gear wheel 38 to the said shaft 11 and hence to the gear wheels 13.

The gear wheel 32 also rotates the gear wheel 39 mounted on one end of the shaft 40 parallel to the shaft 28, with the second end of which is rigid a handwheel 41 external to the base 4, for manually adjusting the entire operating and control unit shown in FIG. 2. The drive shaft 28 is arranged to drive both the belts 14 and 15 and a transfer unit disposed at the outlet station 6 and arranged to transfer the preshaped pieces 3 from the conveyor 1 to the conveyor 2. Conveyor 2 (see FIG. 1) extends inside a box housing and comprises an inlet station constituted by two horizontal superimposed shafts 42 connected together by gear wheels 43 and comprising feed drums 44 radially in contact with each other. Between the shafts 42 there extend two pairs 45 and 46 of elongate horizontally extending vertical knives or bars defining therebetween slide slots for the preshaped pieces 3. The bars 45, 46 are seen to extend in the direction of movement of conveyor 2 and perpendicular to the direction of conveyor 1. The lower knives of these pairs extend above the shoulder 22 and define a support and slide surface for the preshaped pieces 3 along the conveyor 2, this surface being disposed at a higher level than the support and slide surface for the preshaped pieces 3 along the conveyor 1. The upper knives extend inside the outlet station 6 above the plate 16 and beam 18 and in superposed relation to the outlet end of conveyor 1.

The said transfer unit comprises a lifting unit 47 (FIG. 2) for raising the preshaped pieces 3 against the upper knives 45 and 46 as these pieces stop at the outlet station 6, a support unit 48 for keeping the preshaped pieces 3 in said raised position and to constitute a lateral inlet guide for the conveyor 2, and a pusher unit 49 arranged to cooperate with the preshaped pieces 3 in said raised position to thrust them into the slot defined by the pairs of knives 45 and 46 and between the feed drums 44. The lifting unit 47 comprises a vertical tubular rod 50 connected upperly to a tubular connector 51 extending through a hole provided in the plate 16, and a second vertical tubular rod 52 extending through a hole provided in the plate 17. The tubular rod 50, provided upperly with a horizontal plate 53 having a hole, and the tubular rod 52 are connected through ducts, not shown, to a suction distributor device or vacuum source, also not shown, controlled by the eccentric pin 86 situated at one end of the shaft 28.

The tubular connector 51 extends through a hole provided in the beam 18 and terminates upwardly in a sucker 54 coplanar with the upper surface of the plate 53.

The rod 52 has connected to its upper end a vertical plate 55 disposed parallel to the feed direction of the conveyor 1, comprising three equidistant upper teeth 56 with a hole at the intermediate tooth. The free end of these teeth 56 is flat and is coplanar with the plate 53 to form with this latter a flat lifting surface for the preshaped pieces 3. The rods 50 and 52 extend upwards from a transverse shaft 57 rotatably connected to the big end of a connecting rod 58, the small end of which is hinged to a crank 59. This latter is keyed on a transverse shaft 60 rotatably supported by the base 4 and provided with a second crank 61 supporting a cam following roller 62 engaged in a groove 63 in the disc cam 64 keyed on the said shaft 28.

The support unit 48 comprises two jaws 65 and 66 of L shape, disposed facing each other at the outlet station 6 above the plates 16 and 17 and beam 18, and are connected to respective horizontal transverse shafts 67 and 68 rotatably supported by the base 4.

On one end of the shafts 67 and 68 are keyed two toothed sectors 69 and 70 which are in mutual engagement and of which the sector 69 comprises an eccentric pin 71 constituting the pivot for a connecting rod 72.

The big end of this latter is constituted by a fork 73 defining a rectangular axial recess in which a shoe 74 is engaged, supported idly by the continuously rotating shaft 28 on which there is also keyed a cam disc 75.

The idle roller 77 carried by the connecting rod 72 runs in the groove 76 in said cam 75.

The pusher unit 49 comprises a horizontal transverse rod 78 slidable axially and substantially aligned with the longitudinal axis of the conveyor 2. A comb-shaped plate 79 is connected to the end of the rod 78 in a normal direction thereto and facing the conveyor 2, and comprises lowerly two teeth 80 arranged to pass between the teeth 56. The other end of the rod 68 is connected via the connecting rod 81 to one end of a rocker arm 82 pivoted in a horizontal axis perpendicular to the rod 78 and provided at its other end with a cam following roller 83 engaged in a groove 84 provided on the periphery of a drum cam 85 keyed on the shaft 28.

Figure 3:
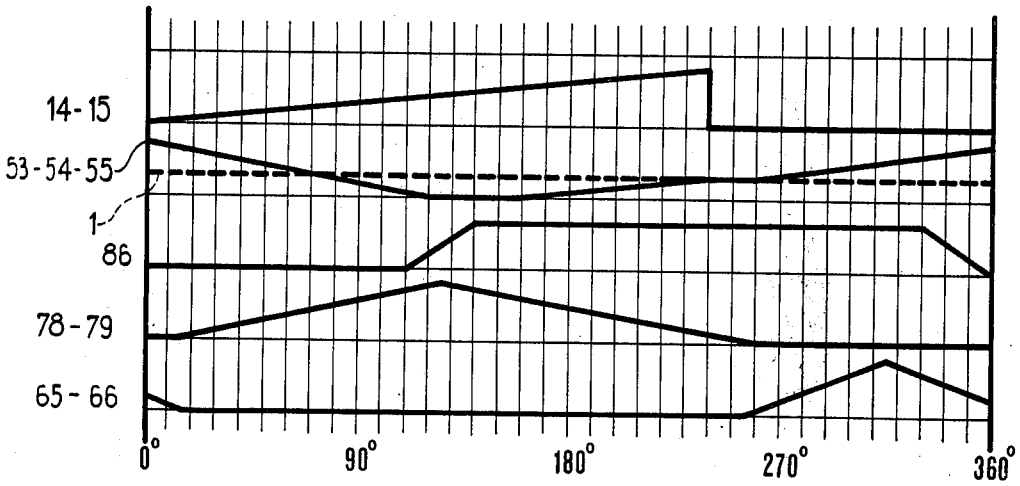
FIG. 3 shows time-phase diagrams for the said mobile elements for one working cycle of said elements.

The transfer of a preshaped piece 3 from the conveyor 1 to the conveyor 2 is now described with reference to the working diagrams of FIG. 3. These diagrams relate to one working cycle of the conveyor 1 commencing at the moment in which one of the idle rollers of the device 34 engages with the Maltese cross 35 so as to rotate it, i.e. the moment in which the belts 14 and 15 begin a forward step as a result of which a preshaped piece 3 is brought to the outlet station 6 on to the plate 53 by the sucker 54 and teeth 56. However for simplicity, said transfer operation will be described commencing at the moment in which the belts 14 and 15 stop after carrying a preshaped piece 3 to the outlet station 6. At the moment when the belts 14 and 15 stop, the plate 53, the sucker 54 and plate 55 are at rest at the level of the support and slide surface of the conveyor 1 below said preshaped piece 3. This latter is held both by the plates 53 and 55 and by the sucker 54 as these have already been connected by the said distributor to the source of suction (not shown) by the control eccentric 86. At the said moment, the comb-shaped plate 79 is disposed in its withdrawn rest position, i.e. is disposed in its furthest position from the inlet station of the conveyor 2, while the jaws 65 and 66 are disposed in their closed position above the station 6.

Following the moment described, the continuous rotation of the shaft causes the rods 50 and 52 to rise via the cam 64, so causing the preshaped piece 3 disposed above the plate 53, sucker 54 and plate 55 to rise upwards. Simultaneously, the rotation of the cam 75, rotated synchronously by the shaft 28, causes a downward movement of the connecting rod 72 and the corresponding opening of the jaws 65 and 66, which thus enable the preshaped piece 3 raised by the lifting unit 47 to pass upwards. Continuing their upward stroke, the rods 50 and 52 bring the preshaped piece 3 between the jaws 65 and 66 is contact with an abutment surface constituted by the upper knives of the two pairs 45 and 46 of the conveyor 2, and then re-descend. Simultaneously, the distributor device closes the connection with said suction source, and the connecting rod 72 is thrust upwards by the cam 75 to close the jaws 65 and 66 on to the preshaped piece. The further descent of the rods 50 and 52 then leaves the preshaped piece 3 on the jaws 65 and 66 which hold it in a position perfectly aligned with the conveyor 2 at a level coplanar with the support and slide surface defined by the lower knives of the pairs 45 and 46. At this point it should be noted that the jaws 65 and 66 are necessary not only to dispose the preshaped piece 3 in the precise position for entry to the conveyor 2, but also to enable the rods 50 and 52 to move immediately downwards and bring the plate 53, sucker 54 and plate 55 below the support and slide surface of the conveyor 1 so as not to interfere with the tie bar 19 of the next conveying compartment fed to the station 6 by the subsequent forward movement of the conveyor 1.

When the preshaped piece 3 is left between the jaws 65 and 66, the comb-shaped plate 79, which up to this time was kept in its withdrawn position by the cam 85, is now moved forward by this latter towards the raised preshaped piece 3 to push it between the feed drums 44 of the conveyor 2.

The comb-shaped plate 79 is disposed at such a level that it extends partly above and partly below the raised preshaped piece 3 so as to ensure positive engagement with the lateral edge of the preshaped piece facing it.

It should be noted in this respect that this positive engagement between the preshaped piece 3 and plate 79 is one of the essential characteristics of the conveying unit described, and constitutes one of the fundamental reasons why the support and slide surfaces of the two conveyors 1 and 2 are disposed at different levels, this characteristic making it necessary to use the lifting unit 47 and support unit 48.

It should also be noted that the lifting teeth 56 and pushing teeth 80 are necessary to prevent the two vertical plates 55 and 79 from interfering with each other during the working stroke of the rod 78, because due to the high working frequency of the conveyor 1, the plate 79 must be moved forward as soon as the plate 55 leaves the preshaped piece at the jaws 65 and 66.

The return of the plate 79 to its withdrawn position coincides substantially with the halting of a new preshaped piece 3 on the station 5 and the beginning of a new working cycle analogous to that previously described.

What I claim is:

1. A conveying unit for feeding portions of sheet material, particularly preshaped or punched pieces of cardboard or the like, the conveying unit comprising two conveyors forming a contained angle substantially of 90° and carrying said preshaped pieces, and each conveyor having a support and slide surface for said preshaped pieces and means for feeding such preshaped pieces intermittently along said surface, and in which an outlet station of a first of said conveyors is connected to an inlet station of the second conveyor by way of transfer means arranged to transfer the preshaped pieces from said first to said second conveyor, the support and slide surface of said second conveyor is disposed at a higher level than that of the first, and said transfer means comprise lifting means which move with reciprocating motion through the support and slide surface of said first conveyor at said outlet station to raise the preshaped pieces one by one to raised position at the higher level of the support and slide surface of said second conveyor, mobile support and guide means disposed above said outlet station to support each preshaped piece in said raised position, said mobile support and guide means moving between a first preshaped piece-supporting position and a second non-interfering position to allow the preshaped pieces to be raised without interference to said raised position, the mobile support and guide means including two substantially L-shaped jaws disposed above said outlet station and extending horizontally in the direction of the second conveyor and in widely spaced relation with each other, and having horizontal shelves to support the opposite side edges of the preshaped carboard pieces lifted to raised position by said lifting means, each of said jaws being rotatable about an axis parallel to the feed direction of said second conveyor between said second or rest position in which it does not interfere with the lifting path for the preshaped pieces and said first or working position in which, together with the other jaw, it supports a preshaped piece in its raised position, and pusher means mobile with horizontal reciprocating motion and in the direction of the second conveyor and above said outlet station to and from said inlet station of the second conveyor to laterally engage each of said preshaped pieces in said raised position and thrust it on to said inlet station.

2. A conveying unit as claimed in claim 1, wherein said second conveyor includes elongate guide elements extending horizontally along and above the support and slide surface of the second conveyor to control the vertical position of the preshaped pieces moving along said surface, said guide elements extending endwise of said second conveyor and from the inlet station thereof and into superposed relation with said outlet station of the first conveyor and in obstructing relation with the upward movement of the preshaped pieces being raised by said lifting means.

3. A conveying unit as claimed in claim 1, wherein said lifting means comprise at least one lifting element with an upper flat surface to engage and lift the preshaped pieces and supported by a vertical rod mobile axially between a lower rest position in which the upper surface is at the most at the level of the support and slide surface of said first conveyor, and an upper working position in which said upper surface is substantially coplanar with the support and slide surface of said second conveyor; and the lifting means also including a first vertical comb member lying in a plane parallel to the feed direction of said first conveyor and provided with a plurality of teeth facing upwards and bounded upperly by a preshaped piece-engaging surface coplanar with said upper surface of said flat surface lifting element to move therewith between said lower rest position and said upper working position, connection means being provided at least on said flat surface lifting element to keep the preshaped pieces in contact therewith during their raising.

4. A conveying unit as claimed in claim 3, wherein said connection means comprise at least one suction hole opening in said upper flat surface of said flat surface lifting element.

5. A conveying unit as claimed in claim 3, wherein said pusher means includes a second vertical comb member parallel to and aligned with said first comb member and having a plurality of teeth facing downwards and arranged to pass between the teeth of said first comb member when the first comb member is in its upper working position; said second comb member being disposed at such a level as to extend partly above and partly below the level of the support and slide surface of said second conveyor for engaging and pushing the preshaped pieces.

* * * * *